US008967455B2

(12) United States Patent
Zhou

(10) Patent No.: US 8,967,455 B2
(45) Date of Patent: Mar. 3, 2015

(54) CARTON STRUCTURE

(71) Applicant: Wistron Corp., New Taipei (TW)

(72) Inventor: Loon Zhou, New Taipei (TW)

(73) Assignee: Wistron Corp., New Taipei (TW)

( * ) Notice: Subject to any disclaimer, the term of this patent is extended or adjusted under 35 U.S.C. 154(b) by 0 days.

(21) Appl. No.: 14/069,316

(22) Filed: Oct. 31, 2013

(65) Prior Publication Data

US 2014/0166733 A1 Jun. 19, 2014

(30) Foreign Application Priority Data

Dec. 14, 2012 (CN) ..... 2012 2 0694957

(51) Int. Cl.
*B65D 5/10* (2006.01)
*B65D 5/02* (2006.01)
*B65D 5/46* (2006.01)

(52) U.S. Cl.
CPC ..... *B65D 5/0254* (2013.01); *B65D 5/4604* (2013.01); *B65D 5/46024* (2013.01); *B65D 2101/0015* (2013.01)
USPC ..... 229/147; 229/151; 229/153; 229/183

(58) Field of Classification Search
USPC ..... 229/122, 147, 151, 152, 153, 183
See application file for complete search history.

(56) References Cited

U.S. PATENT DOCUMENTS

| | | | | | |
|---|---|---|---|---|---|
| 340,904 | A | * | 4/1886 | Auchterlonie | 229/152 |
| 1,470,141 | A | * | 10/1923 | Bryson | 229/152 |
| 2,418,963 | A | * | 4/1947 | Anderson, Jr. | 229/183 |
| 2,525,690 | A | * | 10/1950 | Lazow | 229/154 |
| 2,698,124 | A | * | 12/1954 | Hines | 229/122 |
| 2,832,527 | A | * | 4/1958 | Bosche, Jr. | 229/152 |
| 2,997,223 | A | * | 8/1961 | Zastrow | 229/183 |
| 3,058,645 | A | * | 10/1962 | Luterick | 229/186 |
| 3,203,617 | A | * | 8/1965 | Paige | 229/183 |
| 4,066,205 | A | * | 1/1978 | Griffith | 229/122 |
| 4,138,051 | A | * | 2/1979 | Zicko | 229/122 |
| 4,313,547 | A | * | 2/1982 | Osborne | 229/122 |
| 2011/0147444 | A1 | | 6/2011 | Fitzwater | |

* cited by examiner

*Primary Examiner* — Gary Elkins

(57) ABSTRACT

A carton structure is disclosed, which includes a side wall panel, a first end panel, a second end panel, a first lateral panel, and a second lateral panel. The first and second end panels are connected to the side wall panel, respectively. The first and second lateral panels extend outwardly from two opposite edges of the second end panel, wherein the first and second lateral panels are pressed by edges of the first end panel to abut the side wall panel such that the opening of the carton structure can be closed.

13 Claims, 3 Drawing Sheets

CARTON STRUCTURE

CROSS REFERENCE TO RELATED APPLICATIONS

This Application claims priority of China Patent Application No. 201220694957.7, filed on Dec. 14, 2012, the entirety of which is incorporated by reference herein.

BACKGROUND OF THE INVENTION

1. Field of the Invention

The present invention relates to a carton structure and, more particularly, to a carbon structure which can be easily packaged and closed and has tamper evident features.

2. Description of the Related Art

To close a conventional carton structure, excessive amount of materials such as tape is necessary to fix upper and lower lid panels of the carton structure. Additionally, the conventional carton structure generally includes a pair of lateral panels, and after assembly the pair of lateral panels are folded inwardly and face an interior of the carton structure, whereby the bottom surface of the carton structure is not flat. Once the carton structure is impacted, contained products may be damaged. Moreover, to prevent the carton from being intentionally opened when being delivered, a tamper evident tape may be used on upper and lower lid panels of the carton structure. However, this approach is time consuming and unreliable.

BRIEF SUMMARY OF THE INVENTION

In order to overcome the above mentioned drawbacks of the prior art, the invention discloses a carton structure.

According to one of the embodiments of the disclosure, the carton structure includes a side wall panel, a first end panel, a second end panel, a first lateral panel, and a second lateral panel. The side wall panel extends around an interior of the carton structure. The first end panel includes a first transverse edge and two opposite first longitudinal edges. The first end panel is connected to the side wall panel via the first transverse edge, and the two opposite first longitudinal edges are disposed at two sides of the first transverse edge, respectively. The second end panel includes a second transverse edge and two opposite second longitudinal edges. The second end panel is connected to the side wall panel via the second transverse edge, and the two opposite second longitudinal edges are disposed at two sides of the second transverse edge, respectively. The first and second lateral panels respectively extend outwardly from one of the second longitudinal edges, wherein the first and second lateral panels are respectively pressed by the two first longitudinal edges so that the first and second lateral panels abut against the side wall panel.

Through the structural arrangement where the first and second lateral panels are firmly disposed between the side wall panel and the first end panel, the carton structure can be erected without excessive amount of stock material. Additionally, the bottom end of the carton structure may be substantially flat such that the valuable or fragile products may be contained in the carton structure safely.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the contemplated mode of carrying out the invention. This description is made for the purpose of illustrating the general principles of the invention and should not be taken in a limiting sense. The scope of the invention is determined by reference to the appended claims.

Figure 1:
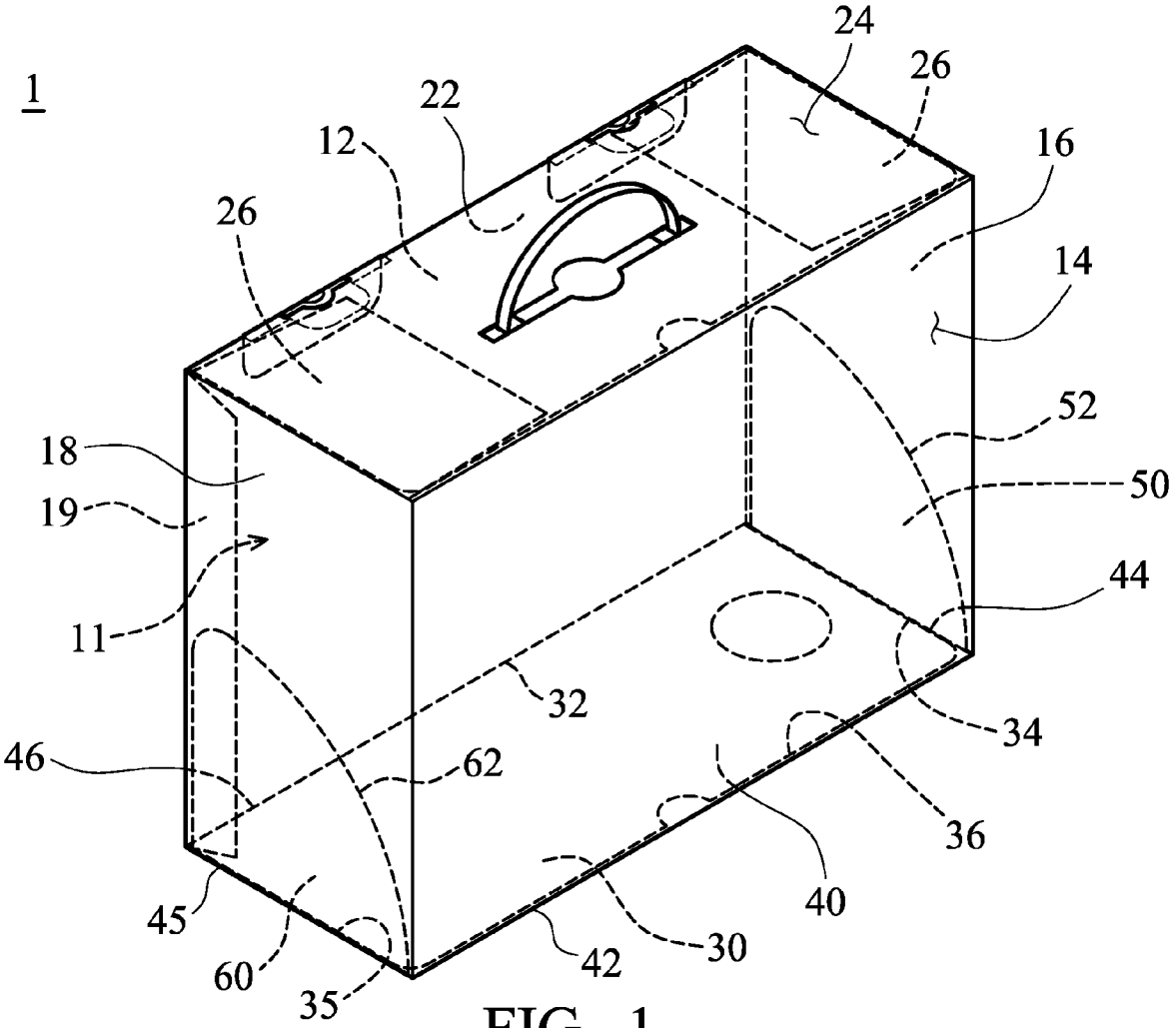
FIG. 1 shows a schematic view of a carton structure of one embodiment of the disclosure in a closed configuration.
Figure 2:
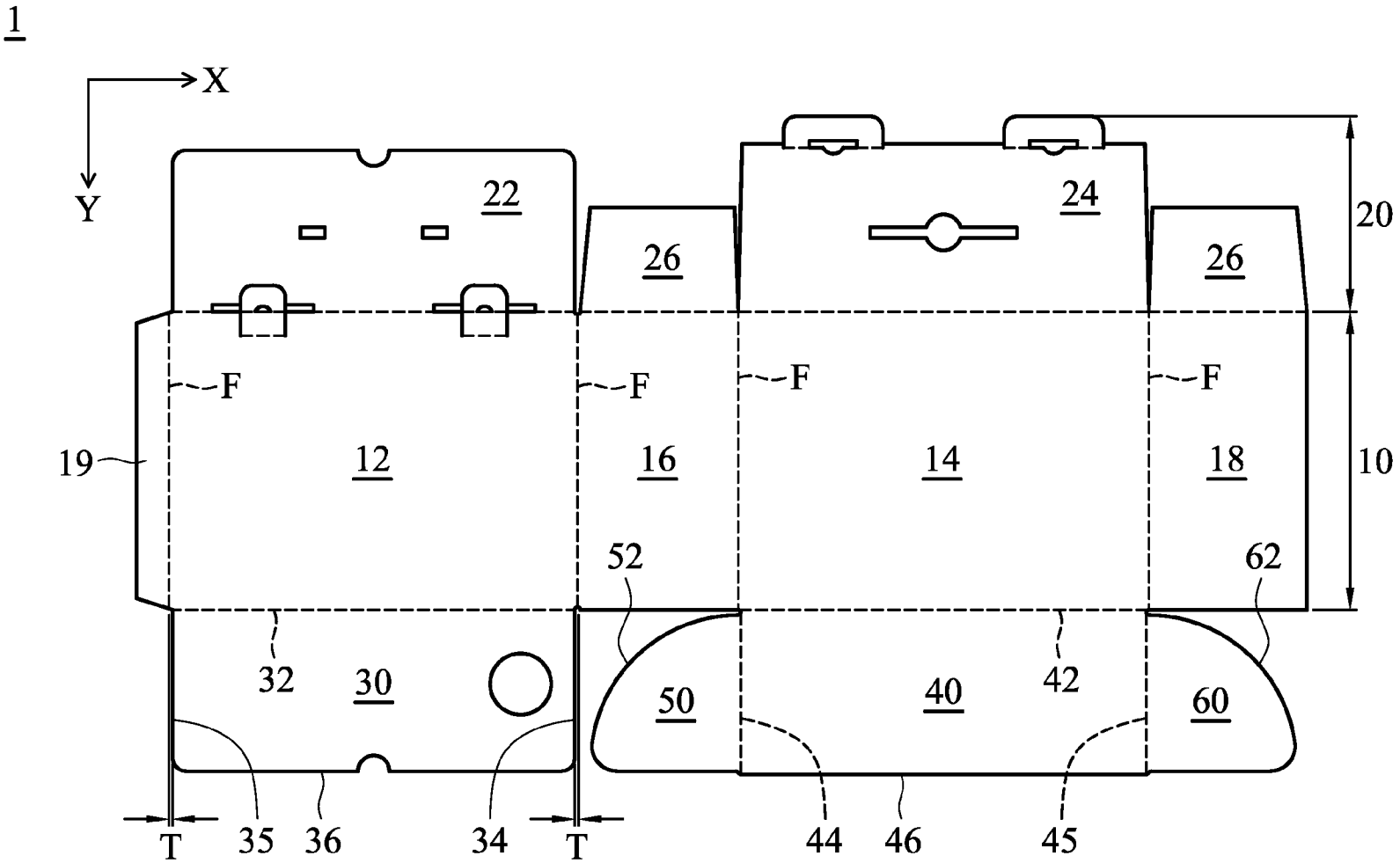
FIG. 2 shows a plan view of a carton blank used to form the carton structure of FIG. 1.

Referring to FIGS. 1 and 2, the carton structure 1 includes a side wall panel 10 (FIG. 2), an upper end panel 20 (FIG. 2), a first end panel 30, a second end panel 40, a first lateral panel 50, and a second lateral panel 60. The side wall panel 10 extends around a tubular interior 11 of the carton structure 1.

Referring to FIG. 2, which shows a plan view of a carton blank used to form the carton structure of FIG. 1. The side wall panel 10 includes two second main wall panels 12 and 14, two minor wall panels 16 and 18 and an attachment panel 19. For the purpose of illustration, the first main wall panel 12 and the second main wall panel 14 refers to the two main wall panels, and the first minor wall panel 16 and the second minor wall panel 18 refer to the two minor wall panels. As shown in FIG. 2, the first main wall panel 12, the first minor wall panel 16, the second main wall panel 14, the second minor wall panel 18 and the attachment panel 19 are arranged alternatively in a traverse direction (X direction), wherein the first main wall panel 12, the first minor wall panel 16, the second main wall panel 14, the second minor wall panel 18 and the attachment panel 19 are foldably connected to each other along the fold lines F. After erecting of the carton structure 1, the attachment panel 19 is connected to an inner surface of the first main wall panel 12.

In the embodiment, the first main wall panel 12, the first minor wall panel 16, the second main wall panel 14 and the second minor wall panel 18 have the same length in the longitudinal direction (Y direction), and the first main wall panel 12 and the second main wall panel 14 have the same length in the traverse direction (X direction), and the first minor wall panel 16 and the second minor wall panel 18 have the same length in the traverse direction (X direction). As shown in FIG. 2, the length of the first main wall panel 12 and the second main wall panel 14 is larger than that of the first minor wall panel 16 and the second minor wall panel 18, but it should not be limited thereto.

The upper end panel 20 is connected to an upper edge of the side wall panel 10 and configured to close the upper opening of the interior 11 (FIG. 1). The upper end panel 20 includes a first lid panel 22, a second lid panel 24 and two web panels 26. The first lid panel 22 is foldably connected to the first main wall panel 12, and the second lid panel 24 is foldably connected to the second main wall panel 14. The two web panels 26 are foldably connected to the first and second minor wall panel 16 and 18, respectively.

The first end panel 30 has a first transverse edge 32, two opposite first longitudinal edges 34 and 35 and a third transverse edge 36. The first and third transverse edges 32 and 36 both extend in the traverse direction (X direction) and face to each other, wherein the first end panel 30 is connected to the first main wall panel 12 of the side wall panel 10 via the first transverse edge 32. Therefore, the first end panel 30 and the first lid panel 22 are disposed at two opposite sides of the first main wall panel 12, respectively. The two first longitudinal edges 34 and 35 both extend in the longitudinal direction (Y direction), wherein the two first longitudinal edges 34 and 35 are disposed at two opposite ends of each of the first and third transverse edges 32 and 36.

The second end panel 40 has a second transverse edge 42, two opposite second longitudinal edges 44 and 45 and a fourth transverse edge 46. The second and fourth transverse edges 42 and 46 both extend in the traverse direction (X direction) and face to each other, wherein the second end panel 40 is connected to the second main wall panel 12 of the side wall panel 10 via the second transverse edge 42. Therefore, the second end panel 40 and the second lid panel 24 are disposed at two opposite sides of the second main wall panel 14, respectively. The two second longitudinal edges 44 and 45 both extend in the longitudinal direction (Y direction), wherein the two second longitudinal edges 44 and 45 are disposed at two opposite ends of each of the second and fourth transverse edges 42 and 46.

It is noted that, in the embodiment, a length in the traverse direction (X direction) of the first transverse edge 32 is smaller than a length in the traverse direction (X direction) of the second transverse edge 42, a length in the longitudinal direction (Y direction) of each of the two first longitudinal edges 34 and 35 is equal to a length in the longitudinal direction (Y direction) of each of the two second longitudinal edges 44 and 45, and the length in the longitudinal direction (Y direction) of each of the two second longitudinal edges 44 and 45 is equal to a length in the traverse direction (X direction) of each of the first and second minor wall panels 16 and 18. The advantages of the above-mentioned structural features may be further understood with reference to the illustration of FIG. 3.

The first lateral panel 50 extends outwardly from the second longitudinal edge 44, and the second lateral panel 60 extends outwardly from the second longitudinal edge 45. Both of the first and second lateral panels are fan shaped and respectively include curved edges 52 and 62 for facilitating the erecting of the carton. In the other embodiment, the first and second lateral panels 50 and 60 are rectangular or triangular.

Figure 3:
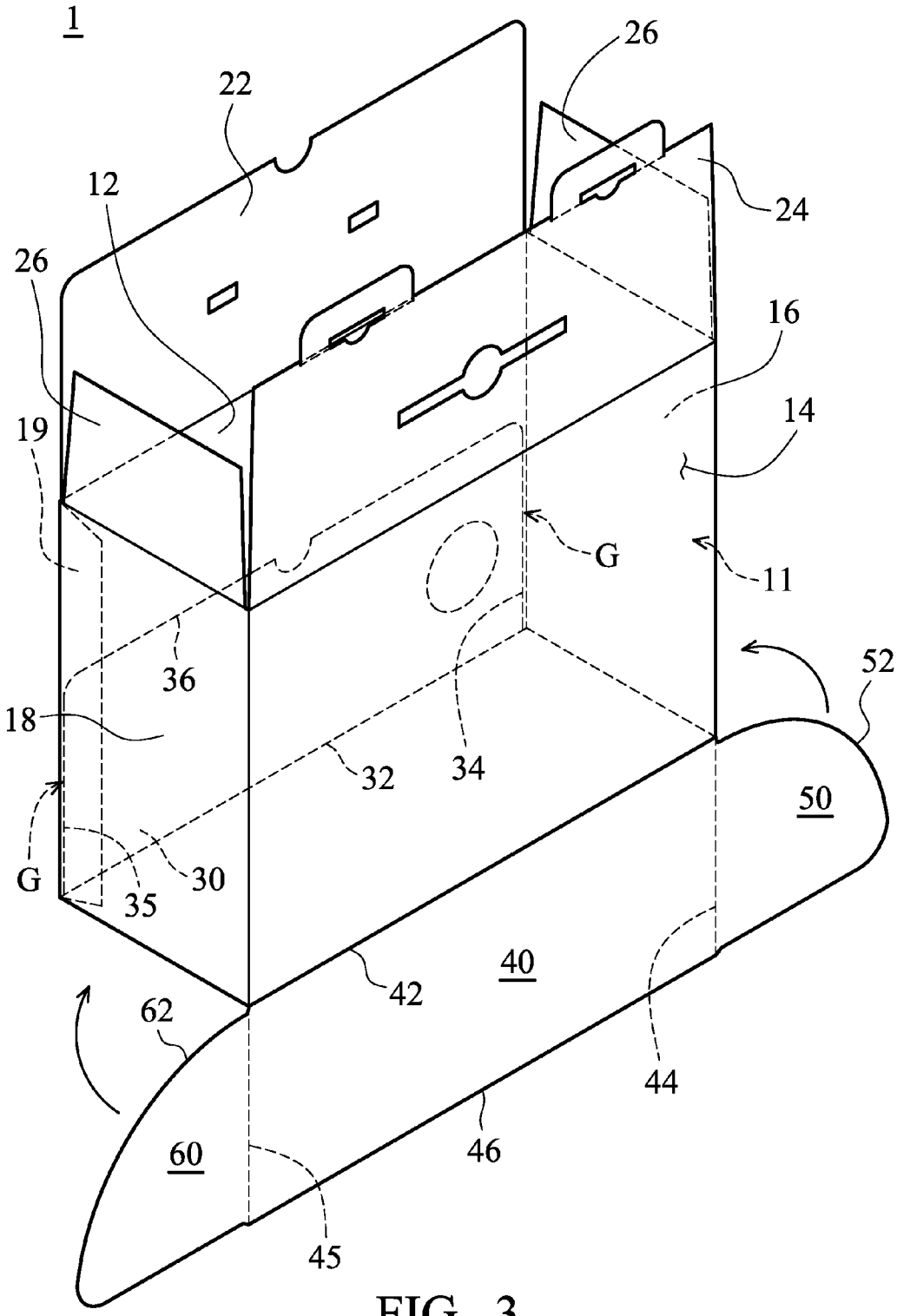
FIG. 3 shows a schematic view of the carton structure of FIG. 1 in a partially closed configuration, wherein the first end plate 30 has been inwardly folded.

In erecting of the carton structure 1, the side wall panel 10 is firstly folded along the fold lines F to form the tubular interior 11 of the carton structure 1. Next, as shown in FIG. 3, the upper and lower openings of the interior 11 are closed. In one exemplary embodiment, while closing the carton structure 1, the lower opening of the interior 11 is closed prior to the upper opening of the interior 11. More specifically, to close the upper opening of the interior 11, the two web panels 26, the first lid panel 22, and the second lid panel 24 are folded inwardly in order and fixed by suitable means, for example by fastening structures or by glue materials.

To close the lower opening of the interior 11, the first end panel 30 is folded inwardly along the first transverse edge 32, so as to temporarily allow the first end panel 30 to abut the inner surface of the first mail wall panel 12. It is noted that due to the structural feature where the length of the first transverse edge 32 is smaller than the length of the second transverse edge 42, two gaps G with a width T are respectively disposed between the first minor wall panel 16 and the first longitudinal edges 34 and disposed between the second minor wall panel 18 and the first longitudinal edges 35, wherein a total width of the two gaps G (i.e. two times of the width T) is smaller than or equal to a total thickness of the first and second lateral panels 50 and 60.

Next, the first and second lateral panels 50 and 60 are folded inwardly along the corresponding second longitudinal edges 44 and 45 (as shown by arrow), and the second end panel 40 is simultaneously folded inwardly along the second transverse edge 42 so that the first and second lateral panels 50 and 60 are respectively disposed in the two gaps G. Finally, as shown in FIG. 1, the first end panel 30 is folded outwardly to abut the second end panel 40. At this time, the first and second lateral panels 50 and 60 are respectively pressed by the first longitudinal edges 34 and 35 of the first end panel 30 whereby the first lateral panel 50 may abut against the minor wall panel 16 and the second lateral panel 60 may abut against the minor wall panel 18.

In the embodiment, due to the structural feature where the length of each of the two second longitudinal edges 44 and 45 is equal to the length of each of the first and second minor wall panels 16 and 18, the lower opening of the interior 11 is completely covered by the second end panel 40. Additionally, due to the structural feature where the length of each of the two first longitudinal edges 34 and 35 is equal to the length of each of the two second longitudinal edges 44 and 45, the inner surface of the second end panel 40 is covered by the first end panel 30. That is, the third transverse edge 36 overlaps with the second transverse edge 42, and the fourth transverse edge 46 overlaps with the first transverse edge 32 such that the bottom surface of the carton structure may be substantially planar. According to one testing result, the bottom of the carton structure 1 has uniform stress distribution, whereby contained products in the carton structure 1 can be well protected.

Through the arrangement of the first and second end panels 30 and 40 and the two lateral panels 50 and 60, the carbon structure 1 of the disclosure is able to be closed firmly without excessive amount of stock material. Moreover, since the two lateral panels 50 and 60 are tightly fixed between the side wall panel 10 and the first end panel 30, the second end panel 40 is unable to be moved. Thus, once the second end panel 40 is intentionally opened, the two lateral panels 50 and 60 and the structure adjacent thereof may be damaged. Through inspection of the carbon structure 1, it can be determined whether the carbon structure 1 is opened, thereby increasing safety of the carbon structure 1.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A carton structure, comprising:

a side wall panel, extending around an interior of the carton structure;

a first end panel, at least comprising:

a first transverse edge, wherein the first end panel is connected to the side wall panel via the first transverse edge; and two opposite first longitudinal edges, disposed at two sides of the first transverse edge, respectively;

a second end panel, at least comprising:

a second transverse edge, wherein the second end panel is connected to the side wall panel via the second transverse edge; and two opposite second longitudinal edges, disposed at two sides of the second transverse edge, respectively;

a first lateral panel, extending outwardly from one of the second longitudinal edges; and a second lateral panel, extending outwardly from the other second longitudinal edge, wherein the first and second lateral panels are respectively pressed by the two first longitudinal edges so that the first and second lateral panels abut against the side wall panel, and wherein each of the first and the second lateral panels has a curved edge extending from an end of said second transverse edge.

2. The carton structure as claimed in claim 1, wherein the side wall panel comprises two main wall panels and two minor wall panels arranged alternatively and foldably connected to each other, wherein the first and second end panels are respectively connected to one of the two main wall panels.

3. The carton structure as claimed in claim 2, wherein the first and second lateral panels are in contact with one of the minor wall panels.

4. The carton structure as claimed in claim 2, wherein the first lateral panel is disposed between one of the two first longitudinal edges and one of the two minor wall panels and the second lateral panel is disposed between another first longitudinal edge and another minor wall panel.

5. The carton structure as claimed in claim 2, wherein the first end panel further comprises a third transverse edge opposite to the first transverse edge, wherein the third transverse edge overlaps with the second transverse edge.

6. The carton structure as claimed in claim 5, wherein the second end panel further comprises a fourth transverse edge opposite to the second transverse edge, wherein the fourth transverse edge overlaps with the first transverse edge.

7. The carton structure as claimed in claim 1, wherein a length of each of the two first longitudinal edges is equal to a length of each of the two second longitudinal edges.

8. The carton structure as claimed in claim 1, wherein a length of the first transverse edge is smaller than a length of the second transverse edge.

9. The carton structure as claimed in claim 8, wherein a difference between the length of the first transverse edge and the length of the second transverse edge is less than a total thickness of the first and second lateral panels.

10. The carton structure as claimed in claim 1, wherein the first and second lateral panels are fan shaped.

11. The carton structure as claimed in claim 1, wherein the side wall panel comprises an attachment panel, a first main wall panel, a first minor wall panel, a second main wall panel, and a second minor wall panel arranged sequentially, and the second end panel connects to the second main wall panel, wherein the second end panel further comprises a fourth transverse edge opposite to the second transverse edge, and each of the first and the second lateral panels comprises an extension edge immediately adjacent to the fourth transverse edge and extending in a direction parallel to the second transverse edge, and wherein the extension edge of the first lateral panel abuts against a fold line between the first main wall panel and the first minor wall panel, and the extension edge of the second lateral panel abuts a fold line between the first main wall panel and the attachment panel.

12. The carton structure as claimed in claim 1, wherein the second end panel further comprises a fourth transverse edge opposite to the second transverse edge, and each of the first and the second lateral panels comprises an extension edge immediately adjacent to the fourth transverse edge and extending in a direction parallel to the second transverse edge.

13. The carton structure as claimed in claim 12, wherein the curved edge connects the extension edge to the second transverse edge.

* * * * *